US006650034B2

(12) United States Patent
Watanabe et al.

(10) Patent No.: US 6,650,034 B2
(45) Date of Patent: Nov. 18, 2003

(54) COLOR CATHODE RAY TUBE

(75) Inventors: Mitsuru Watanabe, Mutsusawa (JP); Yoshinori Ito, Mobara (JP)

(73) Assignee: Hitachi, Ltd., Tokyo (JP)

( * ) Notice: Subject to any disclaimer, the term of this patent is extended or adjusted under 35 U.S.C. 154(b) by 288 days.

(21) Appl. No.: 09/835,720

(22) Filed: Apr. 16, 2001

(65) Prior Publication Data

US 2002/0017851 A1 Feb. 14, 2002

(30) Foreign Application Priority Data

Aug. 11, 2000 (JP) ..... 2000-243788

(51) Int. Cl.[7] ..... H01J 29/80
(52) U.S. Cl. ..... 313/402; 313/408; 313/477 R
(58) Field of Search ..... 220/2.1 A, 2.1 R, 220/2.3 A; 313/408–412, 402, 407, 461, 477 R, 478, 469

(56) References Cited

U.S. PATENT DOCUMENTS 4,675,571 A * 6/1987 Bakker et al. ..... 313/461
5,319,280 A * 6/1994 Vriens ..... 313/413

* cited by examiner

*Primary Examiner*—Sandra O'Shea
*Assistant Examiner*—Sumati Krishnan
(74) *Attorney, Agent, or Firm*—Milbank, Tweed, Hadley & McCloy LLP

(57) ABSTRACT

The present invention provides an improved feeling of flatness of a color cathode ray tube which facilitates the coating operation of a phosphor layer or enlarges an effective area of the phosphor layer. The effective area 4*b* of the phosphor layer 4 which is formed on an inner surface of a panel and has an approximately rectangular shape is formed in a pincushion shape. At end portions in a diagonal axis D direction of this pincushion-shaped phosphor layer 4*b*, corner-portion peripheries 4C having a curvature R which are formed in a convex shape outwardly from the effective region 4*b* are formed in corner regions which connect long-side peripheries sandwiching an X axis and short-side peripheries sandwiching a Y axis.

20 Claims, 6 Drawing Sheets

COLOR CATHODE RAY TUBE

BACKGROUND OF THE INVENTION

The present invention relates to a color cathode ray tube, and more particularly to a so-called flat panel type color cathode ray tube which is provided with a panel whose inner surface is coated with a phosphor layer and whose outer surface has the radius of curvature extremely larger than that of an inner surface thereof.

Recently, color cathode ray tubes called the flat face type or the flat panel type have been widely adopted as picture tubes for television receivers or monitor display tubes of personal computers or the like.

Generally, a glass-made envelope of a color cathode ray tube is composed of a panel which forms a display part (screen), a narrow-diameter neck and a funnel in a funnel shape which connects the panel with the neck. A phosphor screen (phosphor film) coated with a phosphor in three colors is formed on the inner surface of the panel and a shadow mask which works as a color selection electrode is disposed close to this phosphor screen.

Further, an electron gun which emits three electron beams arranged in in-line is accommodated in the inside of the neck and three electron beams emitted from the electron gun are made to pass through beam apertures formed on the shadow mask and are impinged on respective phosphors to reproduce color images.

Recently, this type of color cathode ray tube has an outer surface of the panel thereof flattened so as to enhance the visibility thereof. Particularly, this flattening of the panel is widely adopted with respect to color cathode ray tubes having large screens. The color cathode ray tubes having such flattened panels are called the flat panel type color cathode ray tubes or the flat-surface panel type color cathode ray tubes.

As literatures which disclose conventional techniques on this kind of flat panel type color cathode ray tube, Japanese Laid-open Patent Publication 45667/1999 and Japanese Laid-open Patent Publication 238475/1999 can be named.

SUMMARY OF THE INVENTION

FIG. 6 is a schematic cross-sectional view showing a structural example of an essential-part of a flat panel type color cathode ray tube. In the drawing, a panel 1 is joined to a periphery of a large diameter which constitutes one end of a funnel 3 and the other end of the funnel 3 which gradually narrows its diameter in a funnel shape is connected to a neck not shown in the drawing.

An outer surface PO of the panel 1 which forms a phosphor screen (screen) having an approximately rectangular shape and coated with a phosphor layer 4 on an inner surface thereof has a curved surface which is substantially a flat surface, wherein the radius of curvature of a curved surface of the inner surface PI is set to be smaller than the radius of curvature of the outer surface PO for maintaining the mechanical strength of a glass-made envelope.

A shadow mask 6 which constitutes a color selection electrode is disposed in the vicinity of this phosphor layer 4. A large number of electron beam passing apertures 6*a* are formed in the shadow mask 6. The shadow mask 6 is welded to a mask frame 7 and is held to the inner surface of a side wall of the panel 1 by way of a suspension mechanism not shown in the drawing.

In view of the manufacturing cost and the easiness of manufacturing, with respect to the above-mentioned flat panel type color cathode ray tube, the outer surface (also called "face") of the panel is set to have a large radius of curvature, that is, the outer surface is set to an approximately flat surface, while the inner surface on which a phosphor layer is formed is set to have a relatively small radius of curvature to a degree that the feeling of a flatness of a displayed image is not spoiled when the display screen is seen from the outer surface.

In manufacturing the flat panel type color cathode ray tube, it is easy to approximate the shape of the outer surface of the panel to the flat surface. However, to approximate the inner surface of the panel to the flat surface, the thickness of the whole panel must be considerably increased to increase the mechanical strength of the glass-made envelope. Therefore, this is not practical in view of the increase of the weight of the cathode ray tube, the increase of cost and the like.

Further, on the other hand, with respect to the shadow mask which is not a color selection electrode of a so-called tension type, it is necessary to form a mask surface thereof with a certain degree of curvature while eliminating a completely flat surface to make the shadow mask stand by itself. Since the manufacturing of a shadow mask having large radius of curvature by a press molding is technically limited, it is necessary to give a given curvature to the shadow mask and simultaneously to give a given curvature to the inner surface of the panel.

As shown in FIG. 6, the curvature of the inner surface Pl of the panel 1 is larger than the curvature of the outer surface PO (the radius of curvature of PI being smaller than the radius of curvature of PO) and the shadow mask 6 approximately follows the shape of the curved surface (warp) of the inner surface Pl of this panel so that the flatness is deteriorated at the peripheries in the long axis side (X axis) on the phosphor layer 4.

In the flat panel type which largely warps the inner surface, there has been a problem that the larger the panel size of the color cathode ray tube (equal to or more than 'nominal 17 inches' (effective screen diagonal diameter being 41 cm)) becomes, the feeling of flatness in the short sides of the screen (end portions in the X axis direction) is worsened due to the aspect ratio of the screen.

Particularly, when the radius of curvature of the outer surface of the panel along the diagonal axis of the screen is not less than 10000 mm and the radius of curvature of the inner surface of the panel along the diagonal axis of the screen is not more than 7000 mm, the peripheries of the effective surface of the phosphor layer which is coated on the inner surface of the panel is made geometrically straight. In such a case, when it is viewed from a viewing position (limited position) which is slightly away from the panel of the color cathode ray tube, the peripheries of the effective surface appears in a barrel shape and hence, the feeling of flatness of the screen is damaged. To cope with such a problem, it is effective to form the shape of the effective region of the phosphor layer in a geometrically pincushion (bobbin) shape. Further, due to such a measure, even when the effective diameters of the screen in the X-axis direction and in the Y-axis direction are fixed, it becomes possible to increase the effective diameter in the diagonal direction. However, the realization of such a measure has problems which will be explained hereinafter.

FIG. 7 is an explanatory view of the shape of the phosphor screen showing the coated shape of the approximately rectangular phosphor layer when the side portions are formed in a linear shape or a pincushion shape. In the drawing, numeral 4 indicates the phosphor layer, numeral 4*a* indicates a contour of the effective region of the linear-shaped phosphor layer, and numerals 4*b* and 4*b*' indicate the contours of the effective regions of the pincushion-shaped phosphor layer.

FIG. 8 is a cross-sectional view showing a corner portion B of the effective region of the linear-shaped or pincushion-shaped phosphor layer shown in FIG. 7 in an enlarged form. In the effective region of the phosphor layer shown in FIG. 7, an axis which is extended in the main scanning direction (in-line arrangement direction of electron beams) and passes the tube axis is set as an X axis, an axis which is extended in the direction perpendicular to the main scanning direction and passes the tube axis is set as a Y axis and an axis which is extended in the diagonal direction and passes the tube axis is set as a D axis.

The contour 4*a* of the effective region of the linear-shaped phosphor layer is approximately accommodated in a front region of the panel 1. However, with respect to the contour 4*b* of the effective region of the pincushion-shaped phosphor layer, when the effective region is ensured along the X axis and the Y axis as much as possible, the effective diameter along the D axis is increased so that the phosphor layer at end portions in the diagonal axis direction of the effective region is extended to the inner surface region close to a skirt portion 1*a* of the panel.

This region close to the panel skirt portion 1*a* is called a blend curved-surface portion defined between the face plate portion and the skirt portion. The blend curved-surface portion has an extremely large curvature compared to the face plate portion and has an extremely large panel wall thickness compared to the face plate portion. In accordance with such a sharp change of the wall thickness of the panel, in a phosphor film coating process, the panel temperature, the distribution of film thickness, the back exposure condition and the like at the blend curved-surface portion are sharply different compared to those at the face plate portion. Further, in the coating process, since the incident angle of light in an exposure step of a phosphor pixel pattern is large particularly in the diagonal direction of the phosphor screen, the exposure illuminance is low and hence, the adhesive strength of the phosphor pixels (for example, dots) becomes weak and this gives rise to pixel defects (for example, dot omission phenomenon). Accordingly, the coating performance (yield) of the phosphor is lowered and the fabrication of the cathode ray tubes becomes difficult.

On the other hand, as in the case of the pincushion-shaped phosphor layer 4*b*', when the effective diameter along the D axis is restricted so as to prevent the phosphor layer at the diagonal end portion from approaching the skirt portion 1*a* of the panel in the same manner as the linear-shaped phosphor layer 4*a*, the effective diameters in the horizontal direction and in the vertical direction respectively gradually become smaller toward the X axis and the Y axis. Accordingly, the area of the effective region of the pincushion-shaped phosphor surface 4*b*' is shrunk compared with the linear-shaped phosphor layer 4*a* so that the image display ability (number of pixels) is reduced.

These have constituted tasks to be solved in the technical field of the color cathode ray tubes.

It is a typical object of the present invention to provide a color cathode ray tube which can increase effective diameters of a screen and can enhance the visual characteristics thereof by suppressing a phenomenon that the screen appears in a barrel shape when observed from a viewing position slightly away from a panel of the cathode ray tube.

It is another typical object of the present invention to provide a color cathode ray tube which can facilitate the fabrication of the cathode ray tube by enhancing the coating performance of a phosphor and can enhance the visual characteristics thereof by suppressing a phenomenon that the screen appears in a barrel shape when observed from a viewing position slightly away from a panel of the cathode ray tube.

According to a typical aspect of the present invention, an approximately rectangular screen effective region which is formed on a panel of a color cathode ray tube is formed in a pincushion shape. Further, curved peripheries which are protruded outwardly from the effective region are provided to end portions in the diagonal axis direction of the pincushion-shaped screen. Further specific constitutions of the present invention are as follows.

A panel which forms a screen effective region in an inner surface thereof and includes a phosphor layer whose contour as seen from the tube axis direction is approximately rectangular has an outer surface thereof formed into an approximately flat surface and the inner surface thereof curved with the radius of curvature smaller than the radius of curvature of the outer surface, and when an axis which is extended in the main scanning direction of the screen effective region and passes the tube axis is set as an X axis, an axis which is extended in the direction perpendicular to the main scanning direction and passes the tube axis is set as a Y axis, and an axis which is extended in the diagonal direction and passes the tube axis is set as a D axis, a coated shape of the phosphor layer is formed in an approximately pin (bobbin) shape, and at end portions in the diagonal axis direction of the phosphor screen, peripheries of long sides of the phosphor layer which sandwich the X axis and peripheries of short sides of the phosphor layer which sandwich the Y axis are connected so as to form corner portion peripheries curved with a given radii of curvature which are protruded outwardly from the effective region.

The equivalent radius of curvature on the outer surface of the panel along the D axis of the screen is set to not less than approximately 10000 mm and the equivalent radius of curvature on the inner surface of the panel along the D axis of the screen is set to not more than approximately 7000 mm.

Gaps on the X axis and the Y axis defined between lines which are connected such that the lines circumscribe respective corner portion peripheries of the approximately pin (bobbin)-shaped phosphor layer and peripheries of side portions of the approximately pin (bobbin)-shaped phosphor layer are set to 0.2 mm–3 mm.

The radius of curvature of curved peripheries of the corner portion peripheries of the phosphor layer is set to 1.5 mm–10 mm.

Due to such a constitution, a flat panel type color cathode ray tube having the favorable visibility and the enlarged effective region can be obtained.

Although operations and effects of the above-mentioned typical constitutions of the present invention will be explained in detail in the paragraphs of embodiment, it is needless to say that the present invention is not limited to those described in the embodiment and various modifications can be considered without departing from the technical ideas of the present invention.

DETAILED DESCRIPTION OF THE PREFERRED EMBODIMENTS

An embodiment of the present invention is hereinafter explained in detail in conjunction with attached drawings.

First of all, a typical structure of a color cathode ray tube of the present invention and a shape of a panel are explained.

Figure 1:
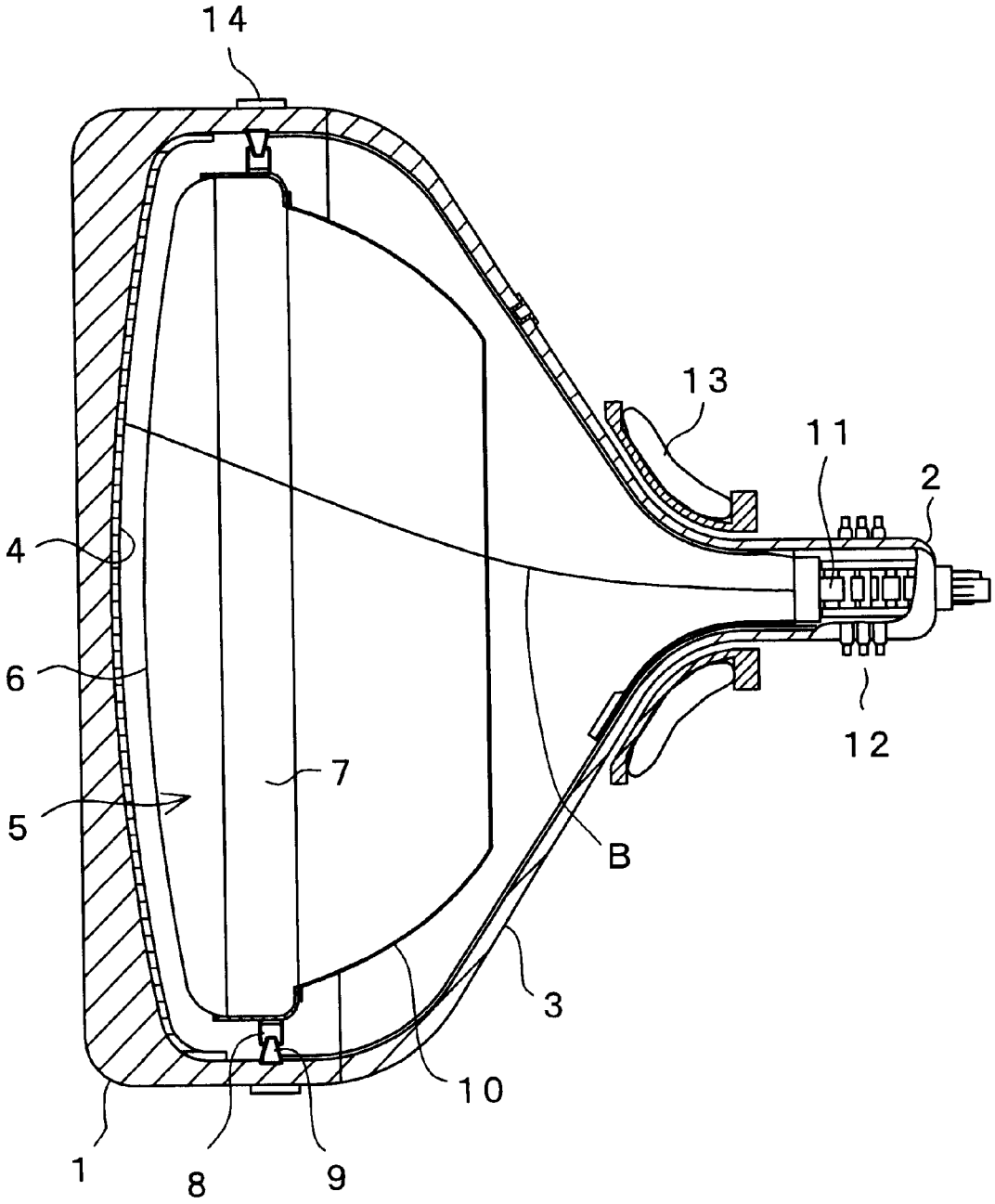
FIG. 1 is a schematic cross-sectional view explaining the entire constitution of a color cathode ray tube according to the present invention.

FIG. 1 is a schematic cross-sectional view explaining the entire constitution of a color cathode ray tube of the present invention. This color cathode ray tube is of a flat panel type whose outer surface has the radius of curvature larger than the radius of curvature of an inner surface thereof. A shadow mask 6 is a so-called press mask having a curved surface which approximately follows the curved surface condition of an inner surface of the panel 1.

An approximately rectangular screen (phosphor film or phosphor screen) is formed on the inner surface of the panel 1 by coating a phosphor film 4 made of tricolor phosphor dots thereon. A shadow mask structural body 5 is disposed in the vicinity of this phosphor film 4. The shadow mask structural body 5 is constituted by welding the shadow mask 6 made of Invar material and having a thickness of 0.13 mm to a mask frame 7 made of steel and having a thickness of 1.2 mm. Suspension mechanisms 8 which are provided with spring members are mounted on side surfaces of the mask frame 7 and these suspension mechanisms 8 are engaged with stud pins 9 embedded into the inner side walls of the panel 1 thus mounting the mask frame 7 in place in a suspended form.

The panel 1 is adhered to a large diameter opening side of a funnel 3, while a small diameter opening side of the funnel 3 is connected to a neck 2. An electron gun 11 which emits three electron beams B in an in-line array is accommodated in the inside of the neck 2. An external magnetic device 12 provided for color purity correction or the like is disposed around the neck portion 2. On a transient region between the funnel 3 and the neck 2, a deflection yoke 13 is exteriorly mounted. The deflection yoke 13 deflects the electron beams B in the horizontal direction as well as in the vertical direction. By performing the scanning in two directions on the phosphor film 4, images are reproduced. A magnetic shield 10 is fixedly secured to the neck side of the mask frame 7 for shielding the electron beams B from an external magnetism such as an earth magnetism or the like. Further, an implosion prevention reinforcing band 14 for preventing an implosion of the panel 1 is wound around an outer periphery of a skirt portion of the panel 1.

Figure 2:
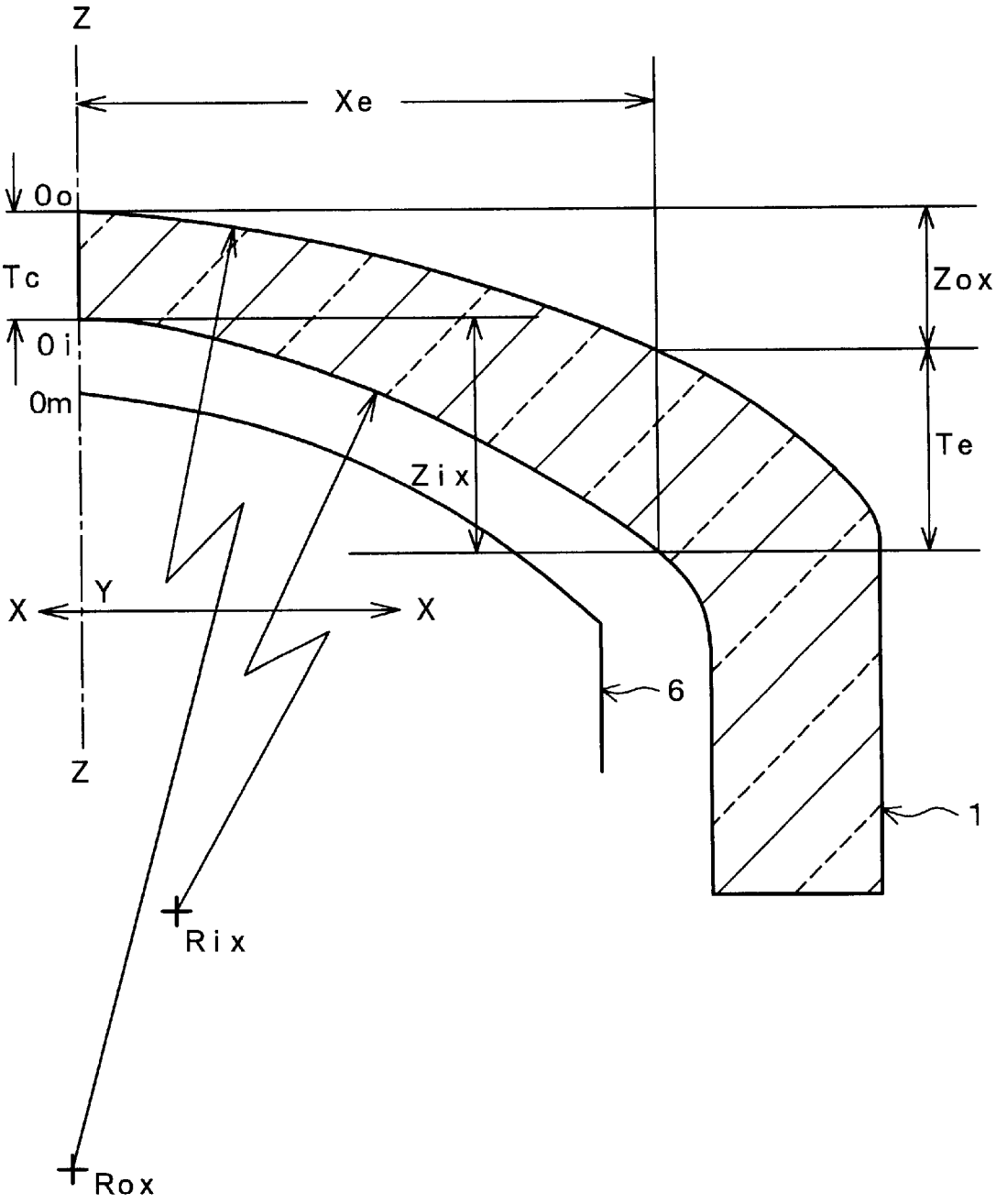
FIG. 2 is a partial cross-sectional view explaining the definition of the equivalent radii of curvature which expresses the curved surfaces of inner and outer surfaces of a panel and a shadow mask.

FIG. 2 is a partial cross-sectional view explaining the detailed shape of the panel 1 and the shadow mask 6. In FIG. 2, to facilitate the understanding of the explanation, the outer surface of the panel 1 has a shape which is warped more compared to the outer surface shown in FIG. 1.

In FIG. 2, an axis of this color cathode ray tube which is extended in the electron beam advancing direction when the electron beams are not deflected in the cathode ray tube and passes the center of the screen (phosphor layer) is set as a Z axis (tube axis), an axis which is extended in the main scanning direction (horizontal direction) of the electron beams and passes the Z axis is set as an X axis, and an axis which is extended in the direction (vertical direction) which intersects the main scanning direction of the electron beams at a right angle and passes the Z axis is set as a Y axis. An X-axis Y-axis plane intersects the Z axis at a right angle and the centers of the inner and outer surfaces (the center of contour) of the panel 1 approximately agree with the Z axis.

By setting an intersecting point of the outer surface of the panel 1 with the Z axis as an outside origin $O_o$ and by setting a fall amount in the Z axis direction from the outside origin $O_o$ at an arbitrary point (x, y) in the phosphor surface region of the outer surface of the panel 1 as $z_o$, the curved surface shape of the outside surface of the panel 1 is generally defined by a following formula.

$$z_o = A1x^2 + A2x^4 + A3y^2 + A4y^4 + A5x^2y^2 + A6x^2y^4 + A7x^4y^2 + A8x^4y^4 \text{ (A1 to A8 being coefficients)}$$

Then, by determining the coefficients A1 to A8, a desired curved surface shape can be obtained.

Further, also with respect to the curved surface shape of the inner surface of the panel 1, by setting an intersecting point of the inner surface of the panel 1 with the Z axis as an inside origin $O_i$ and by setting a fall amount in the Z axis direction from the inside origin $O_i$ at an arbitrary point (x, y) in the phosphor surface region of the inner surface of the panel 1 as $z_i$, the curved surface shape of the inside surface of the panel 1 can be defined in the same manner by replacing $z_o$ with $z_i$.

Further, also with respect to the curved surface shape of the shadow mask 6, by setting an intersecting point of the shadow mask 6 with the Z axis as a mask origin $O_m$ and by setting a fall amount in the Z axis direction from the mask origin $O_m$ at an arbitrary point (x, y) in the apertures region of the shadow mask 6 as $z_m$, the curved surface shape of the shadow mask 6 can be defined in the same manner by replacing $z_o$ with $z_m$.

Further, the curved surface shape of the outer surface of the panel 1 may be generally defined by a following formula.

$$z_o = R_{ox} - \{(R_{ox} - R_{oy} + (R_{oy}^2 - y^2)^{1/2})^2 - x^2\}^{1/2} \quad (1)$$

$$z_o = R_{ox} - (R_{ox}^2 - x^2)^{1/2} + R_{oy} - (R_{oy}^2 - y^2)^{1/2} \quad (2)$$

Here, $R_{ox}$ represents the radius of curvature along the X axis on the outer surface of the panel 1 and $R_{oy}$ represents the radius of curvature along the Y axis on the outer surface of the panel 1. The formula (1) expresses the curved surface shape having the uniform curvature in the radial direction and the formula (2) expresses the curved surface shape having the uniform curvature respectively in the X axis direction and the Y axis direction.

Further, the curved surface shape of the inner surface of the panel 1 is also defined in the similar manner by replacing "o" with "i" in the above definition equation.

The curved surface obtained by the above-mentioned formulae is a non-spherical shape in many cases and the radius of curvature differs depending on the arbitrary position on the curved surface. Then, the curvatures (radii of curvature) of the panel and the shadow mask are defined by the equivalent radii of the curvature.

The equivalent radii of curvature which express the curved surfaces of the inner and outer surfaces of the panel are explained in conjunction with FIG. 2. In FIG. 2, Xe indicates a distance in the direction which intersects the axis Z at a right angle from the center (Z axis) of the panel 1 to the ends of the display region (effective region) in the X axis direction, $T_c$ indicates a thickness in the Z axis direction (panel thickness) at the center of the panel, $T_e$ indicates a thickness in the Z axis direction at the ends of the display region in the X axis direction, $Z_{ox}$ is a fall amount in the Z axis direction between the center $O_o$ of the outer surface of the panel and the peripheries (ends of the effective display region) in the X axis direction, $Z_{ix}$ is a fall amount in the Z axis direction between the center $O_i$ of the inner surface of the panel and the peripheries (ends of the effective display region) in the X axis direction, $R_{ox}$ is the equivalent radius of curvature of the outer surface in the X axis direction of the panel and $R_{ix}$ is the equivalent radius of curvature of the inner surface in the X axis direction of the panel.

Here, following relationships exist between $R_{ox}$, $R_{ix}$, $Z_{ox}$, $Z_{ix}$ and Xe.

$$R_{ox}=(Z_{ox}^2+Xe^2)/(2Z_{ox}),$$

$$R_{ix}=(Z_{ix}^2+Xe^2)/(2Z_{ix})$$

That is, the equivalent radius of curvature is the radius of curvature determined by the distance Xe from the center (the intersecting point with the Z axis) of the panel 1 shown in FIG. 2 to the end of the display region and the fall amounts $Z_{ox}$, $Z_{ix}$ between the center and the peripheries (ends of the effective display region).

Although the above-mentioned equivalent radius of curvature is defined by taking the radius of curvature in the X-axis direction of the panel as an example, the radius of curvature in other direction can be defined in the same manner. Further, the equivalent radius of curvature of the shadow mask 6 can be defined in the same manner.

Further, with respect to the visibility (or visual characteristics: feeling of flatness) in this embodiment, even when panels have the same curvature, depending on the size of the effective screen, panels (planar surface) look flat to human eyes in one case and panels do not look flat to human eyes in the other case.

Then, a following method can be used as a method for evaluating the visibility characteristics (flatness of the panel as seen by human eyes). That is, irrespective of the size of the screen, the equivalent radius of curvature $R_i$ of the inner surface of the standardized panel is set such that $R_i$=40V+40 and the equivalent radius of curvature $R_o$ of the outer surface of the standardized panel is set such that $R_o$=42.5V+45. Here, V means a 'Visual Size' which expresses the effective diameter of the screen in the diagonal direction in inch. For example, the value of V is 20 with respect to the color cathode ray tube of the nominal 21 inches (the diagonal effective diameter of the screen being 51 cm).

Then, the degree of the flatness of the panel is expressed by a multiple of the equivalent radius of curvature $R_o$ of the outer surface of the above-mentioned standardized panel or of the equivalent radius of curvature $R_i$ of the inner surface of the above-mentioned standardized panel.

In the present invention, by setting the equivalent radius of curvature in the diagonal direction in the phosphor surface region of the outer surface of the panel to equal to or more than $10R_o$, the screen is made to look approximately flat. Further, by setting the equivalent radius of curvature to equal to or more than $20R_o$, the screen substantially looks completely flat.

To the contrary, the equivalent radius of curvature in the diagonal direction in the phosphor surface region of the inner surface of the panel is set to equal to or less than $4R_i$ in view of the manufacturing limitation due to the press molding technique of the shadow mask having the curved surface which approximately follows the inner surface of the panel. By setting the equivalent radius of curvature to equal to or less than $3R_i$, the press forming of the shadow mask can be made further easier. Then, by setting the equivalent radii of curvature along the long axis direction and along the short axis direction in the phosphor surface region of the inner surface of the panel to equal to or less than 3000 mm respectively, the dimensional accuracy of the curved surface of the shadow mask by a press molding is enhanced so that the manufacturing yield of the shadow masks when assembled into the color cathode ray tubes becomes stable.

Here, the equivalent radii of curvature along the long axis direction and along the short axis direction in the apertures region of the shadow mask per se are set to equal to or less than 3000 mm so that a desired curved surface shape can be maintained.

Further, to ensure the reduction of weight and the sufficient mechanical strength, the glass wall thickness of the panel is set such that the thickness Td in the Z axis direction at the ends of the display region in the diagonal direction becomes not less than 200% larger than the thickness Tc in the Z axis direction at the center of the display region.

However, when the above-mentioned equivalent radius of curvature of the inner surface of the panel is set to an excessively small value, the difference between the equivalent radius of curvature of the inner surface of the panel and the equivalent radius of curvature of the outer surface of the panel becomes large so that the glass wall thickness of the panel in the peripheral portion of the screen becomes thick and hence, the brightness of the image at this portion is reduced. In the present invention, to reduce the difference of brightness between the central portion and the peripheral portion of the screen of the cathode ray tube, the equivalent radius of curvature in the diagonal direction in the phosphor surface region of the inner surface of the panel is set larger than $2R_i$. Meanwhile, the equivalent radii of curvature along the long axis direction and along the short axis direction in the phosphor surface region of the inner surface of the panel are respectively set to equal to or more than 1500 mm.

Here, the equivalent radii of curvature of the shadow mask per se respectively along the long axis direction and along the short axis direction are set to equal to or more than 1250 mm. Thus, the increase of the distance between the inner surface of the panel and the shadow mask in the peripheral portion of the screen can be suppressed so that the landing displacement of the electron beams to the phosphor pixels due to the influence of the earth magnetism can be reduced.

Figure 3:
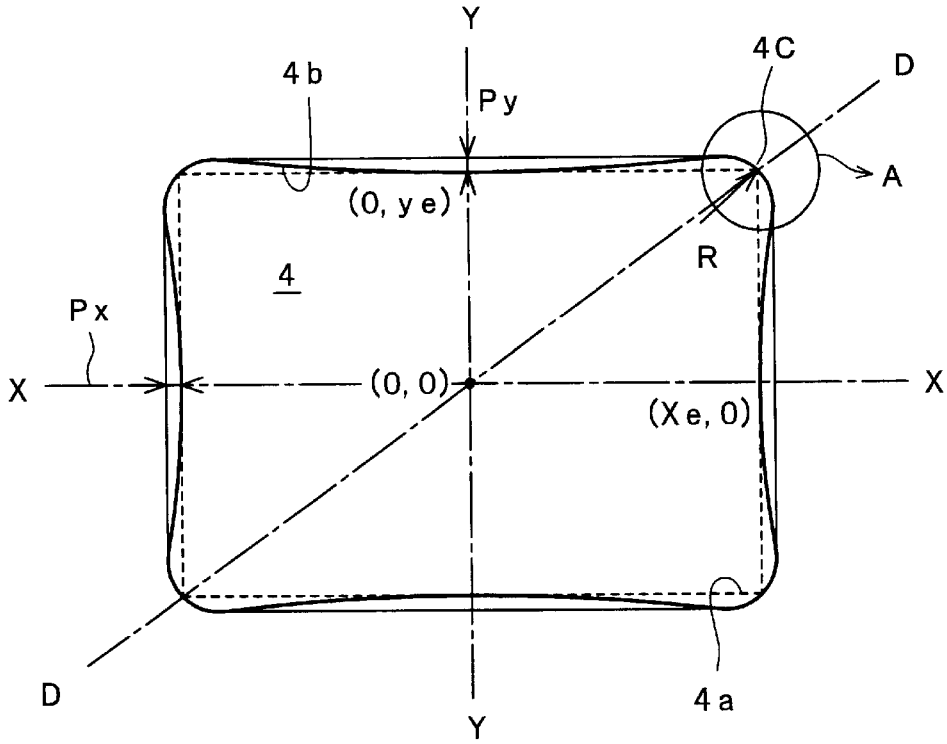
FIG. 3 is a schematic view of a contour of an effective region of a phosphor layer for explaining an embodiment of the color cathode ray tube of the present invention.
Figure 4:
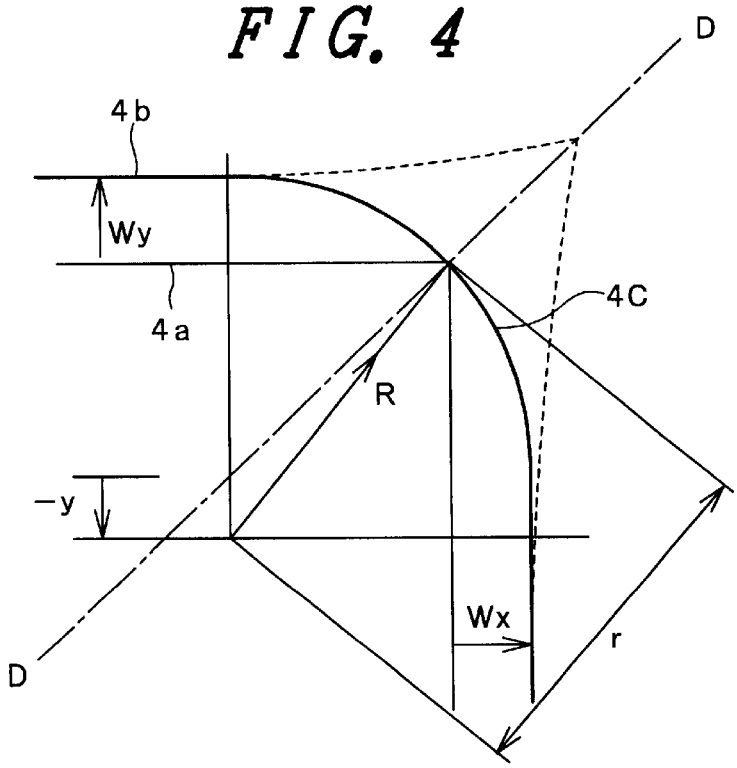
FIG. 4 is an essential-part explanatory view showing an A portion of FIG. 3 in an enlarged form.
Figure 7:
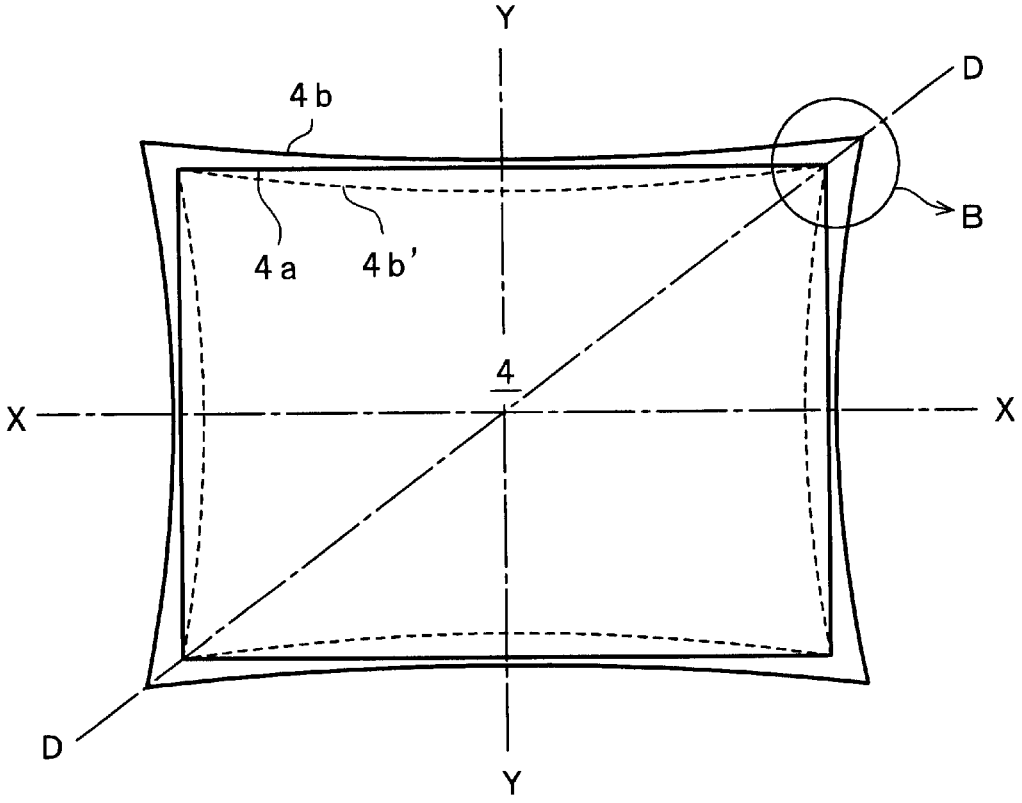
FIG. 7 is an explanatory view of a shape of the phosphor layer when the coated shape of the phosphor layer is formed in a linear shape or a pincushion shape at side portions thereof.
Figure 8:
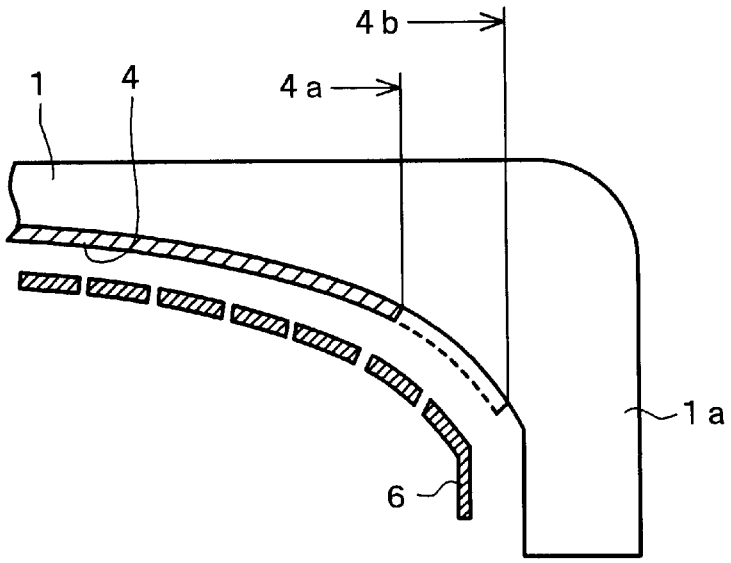
FIG. 8 is an enlarged cross-sectional view which shows the corner portion B of the effective region of the linear-shaped or pincushion-shaped phosphor layer in FIG. 7.

FIG. 3 is an explanatory view of a first embodiment of the color cathode ray tube according to the present invention and is also a schematic view for explaining an approximately rectangular contour in an effective region of the phosphor layer and FIG. 4 is an essential-part explanatory view showing an A portion of FIG. 3 in an enlarged form. In the drawing, numeral 4 indicates the phosphor layer, numeral 4*a* is the effective region of the phosphor layer which is explained in conjunction with the above-mentioned FIG. 7 in which side portions are formed linearly, numeral 4*b* indicates the effective region of the phosphor layer whose side portions are formed in a pincushion shape, and 4C indicates a portion (periphery of the corner portion) having a radius of curvature R.

As shown in FIG. 3 and FIG. 4, an axis extended in the main scanning direction (in-line arrangement direction of electron beams) of the effective region and passes the tube axis is set as an X axis, an axis which is extended in the direction perpendicular to the main scanning direction and passes the tube axis is set as a Y axis, and an axis which is extended in the diagonal direction and passes the tube axis is set as a D axis. In FIG. 3, the effective region 4*a* of the phosphor layer whose side portions are formed in a linear shape is shown by a dotted line.

In this embodiment, the effective region of the approximately rectangular phosphor layer coated on the inner surface of the panel is formed in a pincushion shape at side portions as indicated by numeral 4*b*. This pincushion-shaped phosphor layer has a shape which is recessed by Px on the X axis and Py on the Y axis toward the center of the effective region from straight lines which are connected such that the straight lines circumscribe the peripheries of respective corner portions of the phosphor layer. Although the quantities of Px, Py are changed corresponding to the curvature of the inner surface of the panel, when the equivalent radius of curvature on the outer surface of the panel along the D axis of the effective region is set to not less than approximately 10000 mm and the equivalent radius of curvature of the inner surface of the panel is set to not more than 7000 mm, the result of the experiment shows that it is proper to set the quantities of the Px and Py to approximately 0.2 mm–3 mm. When these quantities are larger than the upper limits of Px, Py, the pincushion shape of the screen becomes apparent at a viewing position of the color cathode ray tube, while when these quantities are lower than the lower limit of the Px, Py, the barrel feeling suppression effect of the screen and the expansion effect of the effective region can be reduced.

Although the above-mentioned Px, Py are values which are measured geometrically, since the outer surface of the panel becomes approximately flat such that the equivalent radius of curvature is not less than 10000 mm in the present invention, even when a scale or the like is directly brought into contact with the outer surface (on the glass) of the panel and the measurement is performed, the measured values become substantially equal to the above-mentioned geometrical values.

Further, the pincushion-shaped side portions are curved toward the center of the effective region with the given curvature. To consider the excessive pin-feeling or barrel-feeling suppression effect of the screen at a viewing position of the color cathode ray tube and the expansion effect of the effective region, it is preferable to set the equivalent radius of curvature of the pincushion-shaped side portions within the range of 50000 mm–2000 mm at the long sides of the screen and within the range of 130000 mm–3000 mm at the short sides.

Further, as shown in FIG. 3, the effective diameters in the horizontal direction and the vertical direction at the effective region 4*b* of the pincushion-shaped phosphor layer are gradually increased as being moved away from the X axis and the Y axis respectively compared to the effective region 4*a* of the linear-shaped phosphor layer.

Further, as shown in FIG. 4, the effective region 4*b* of the pincushion-shaped phosphor layer coated on the inner surface of the panel is coated wider in the vicinity of the peripheries of the corner portions by Wx in the direction parallel to the X axis and by Wy in the direction parallel to the Y axis than the effective region 4*a* of the linear-shaped phosphor layer.

Accordingly, the area of the effective region 4*b* of the pincushion-shaped phosphor layer is enlarged compared to the effective region 4*a* of the linear shaped phosphor layer so that the image display pixel number (resolution) is increased.

In the panel which makes the outer surface thereof approximately flat and the inner surface thereof curved, the above-mentioned barrel feeling of the screen differs depending on the magnitude of the curvatures in the long axis direction and in the short axis direction on the inner surface thereof.

When the radius of curvature of the inner surface of the panel is considerably larger in the short axis direction than in the long axis direction, it may be possible to form only the long sides of the phosphor layer in a pincushion shape while when the radius of curvature of the inner surface of the panel is considerably larger in the long axis direction than in the short axis direction, it becomes possible to form only the short sides in a pincushion shape.

Further, when there is no substantial difference with respect to the radius of curvature of the inner surface of the panel between the long axis direction and the short axis direction, the barrel feeling at the long sides which have the larger effective diameter becomes more apparent in the approximately rectangular screen and hence, by making the recessed quantity Py on the short axis larger than the recessed quantity Px on the long axis, the visual characteristics can be effectively enhanced.

At a corner region which connects the long side periphery and the short side periphery of the phosphor layer in the end portion of the diagonal axis direction of the approximately rectangular pincushion-shaped phosphor layer, the portion (curved periphery) 4C having the curvature R which is protruded in the outer direction of the phosphor screen is formed such that the phosphor layer does not extend to a blend curved surface portion formed between the face plate portion and a skirt portion of the panel. In this manner, by providing the portion 4C having the curvature R to the corner and using this portion 4C as the periphery in the diagonal direction of the phosphor layer, the effective diameter along the D axis can be suppressed so that it becomes possible to prevent the phosphor layer at the end portion in the diagonal direction from extending in the vicinity of the skirt portion of the panel so that coating performance of the phosphor can be increased.

Further, by forming the periphery of the corner portion of the phosphor layer into the curved peripheral portion 4C, the pincushion shape of the phosphor layer can be maintained without decreasing the effective diameters of the effective region along the X axis and Y axis. Further, since the coating performance of the phosphor can be enhanced even when the effective diameter along the D axis of the pincushion-shaped phosphor layer 4*b* is suppressed in the same manner as that of the linear-shaped phosphor layer 4*a*, there is no possibility that the area of the pincushion-shaped phosphor layer 4*b* is shrunk and the image display ability (pixel number) is decreased compared with the linear-shaped phosphor layer 4*a*.

The magnitude of the curvature R of the curved peripheral portion 4C is defined by a radius (radius of curvature r) of a circle which inscribes the curved peripheral portion 4C.

The radius of curvature r of this curved peripheral portion 4C is dependent on the recessed quantities Px, Py along the X axis and the Y axis of the side portions on the pincushion-shaped phosphor layer 4*b*. When the recessed quantities Px, Py are increased under the condition that the effective diameters along the X axis, the Y axis and the D axis of the phosphor layer in the cathode ray tube having a given screen size are fixed considering the ensuring of the effective region area of the phosphor screen and easiness of coating of the phosphor, the radius of curvature r of the curved peripheral portion 4C is increased correspondingly.

As mentioned previously, when the recessed quantities Px, Py are set within the suitable range of 0.2 mm–3 mm from a viewpoint of enhancing the visual characteristics of the screen, in this invention, the radius of curvature r of the curved peripheral portion 4C is set to not less than 1.5 mm to enhance the coating performance of the phosphor. When this radius of curvature r is set to less than 1.5 mm, to ensure the effective diameters along the X axis and the Y axis, the recessed quantities Px, Py become less than 0.2 mm so that it is difficult to expect the sufficient enhancement of the feeling of flatness of the screen. On the other hand, when the radius of curvature r is less than 1.5 mm to ensure the recessed quantities Px, Py of 0.2 mm, the effective diameters along the X axis and the Y axis become small.

Further, when the recessed quantities Px, Py are reduced to approximately 1 mm so as to set the radius of curvature r is to not less than 3 mm, the effective diameters along the X axis and the Y axis become large so that the area of the effective region of the phosphor layer is enlarged whereby the number of image display pixels (resolution) is increased.

Further, according to the present invention, to maintain the square (rectangular) feeling of the screen by smoothly connecting the long-side periphery and the short-side periphery at the corner portion of the pincushion-shaped phosphor layer, the radius of curvature r is set to not more than 10 mm. When the recessed quantities Px, Py are set to more than 2 mm and the radius of curvature r is set to more than 10 mm, although the corner portion of the screen becomes more or less in a chamfered shape and hence, the smoothness is slightly deteriorated, the flat feeling of the screen and the easiness of coating of the phosphor are not affected particularly. That is, the periphery of the corner portion may be formed in a linear shape.

For example, assuming the recessed quantities Px, Py on the X axis and the Y axis of the phosphor layer as 3 mm respectively, in the color cathode ray tubes respectively having the effective screen diagonal sizes of 41 cm and 51 cm, the radii of curvature r of the curved peripheral portions 4C of the corner portions are respectively set to 9.3 mm and 9.5 mm. The panel curved-surface specifications of the color cathode ray tubes of 41 cm and 51 cm are set such that the equivalent radius of curvature of the outer surface along the D axis of the effective screen is not less than 10000 mm and the equivalent radius of curvature of the inner surface along the D axis of the effective screen is not more than 7000 mm.

Further, when the aspect ratio of the effective screen is laterally elongated, the feeling of flatness is damaged particularly at the short sides which have a large viewing angle. Accordingly, to increase the degree of the pincushion shape at the short sides of the effective screen, as shown in FIG. 4, it is preferable to set the center of the radius of curvature r to a position which is offset by y from the D axis toward the X axis of the phosphor layer.

In FIG. 3, assuming the coordinate of the right side end portion along the X axis in the effective region as (xe, 0) and the coordinate of the upper side end portion along the Y axis in the effective region as (0, ye), the D axis of the phosphor layer is defined by a straight line which connects the center coordinate (0, 0) of the effective region and the coordinate (xe, ye) in the vicinity of the corner.

The above-mentioned phosphor layer which forms side portions of the approximately rectangular effective region in a pincushion shape and the corner portions in a curved shape has its shape determined by the contour of the apertures region of the shadow mask which is formed by a press. The contour of the apertures region of the shadow mask can be changed by the adjustment of a curved surface at the time of press forming.

With respect to the contour of the apertures region of the shadow mask formed by a press, the side portions are formed in a pincushion shape in the same manner as the above-mentioned phosphor layer. The recessed quantities of these pincushion-shaped side portions toward the center of the apertures region on the long axis and the short axis are set to 0.2 mm–3 mm as in the case of the recessed quantities Px, Py of the above-mentioned phosphor layer.

Further, when the radius of curvature in the apertures region of the shadow mask is considerably large in the short axis direction than in the long axis direction as in the case of the previously mentioned phosphor layer, it may be possible to form only the long sides of the apertures region in a pincushion shape, while when the radius of curvature is considerably large in the long axis direction than in the short axis direction, it may be possible to form only the short sides in a pincushion shape. Further, when there is no substantial difference with respect to the radius of curvature of the apertures region of shadow mask between the long axis direction and the short axis direction, it may be more effective to make the recessed quantity on the short axis larger than the recessed quantity on the long axis in the same manner as the above-mentioned phosphor layer.

Further, with respect to the pincushion-shaped mask apertures region having the approximately rectangular shape, the corner side peripheries which connect the long side peripheries and the short side peripheries are formed in a curved shape which is protruded in the outward direction from the apertures region as in the case of the above-mentioned phosphor layer. The magnitude of the curved shape of the corner side peripheries is also defined by the radius of curvature and this radius of curvature is set to 1.5 mm–10 mm as in the case of the above-mentioned phosphor layer. However, in view of the relationship with the magnification ratio, the radius of curvature of the corner side peripheries of the mask apertures region is made 2%–3% smaller compared with the radius of curvature of the corner side peripheries of the phosphor layer.

Figure 5:
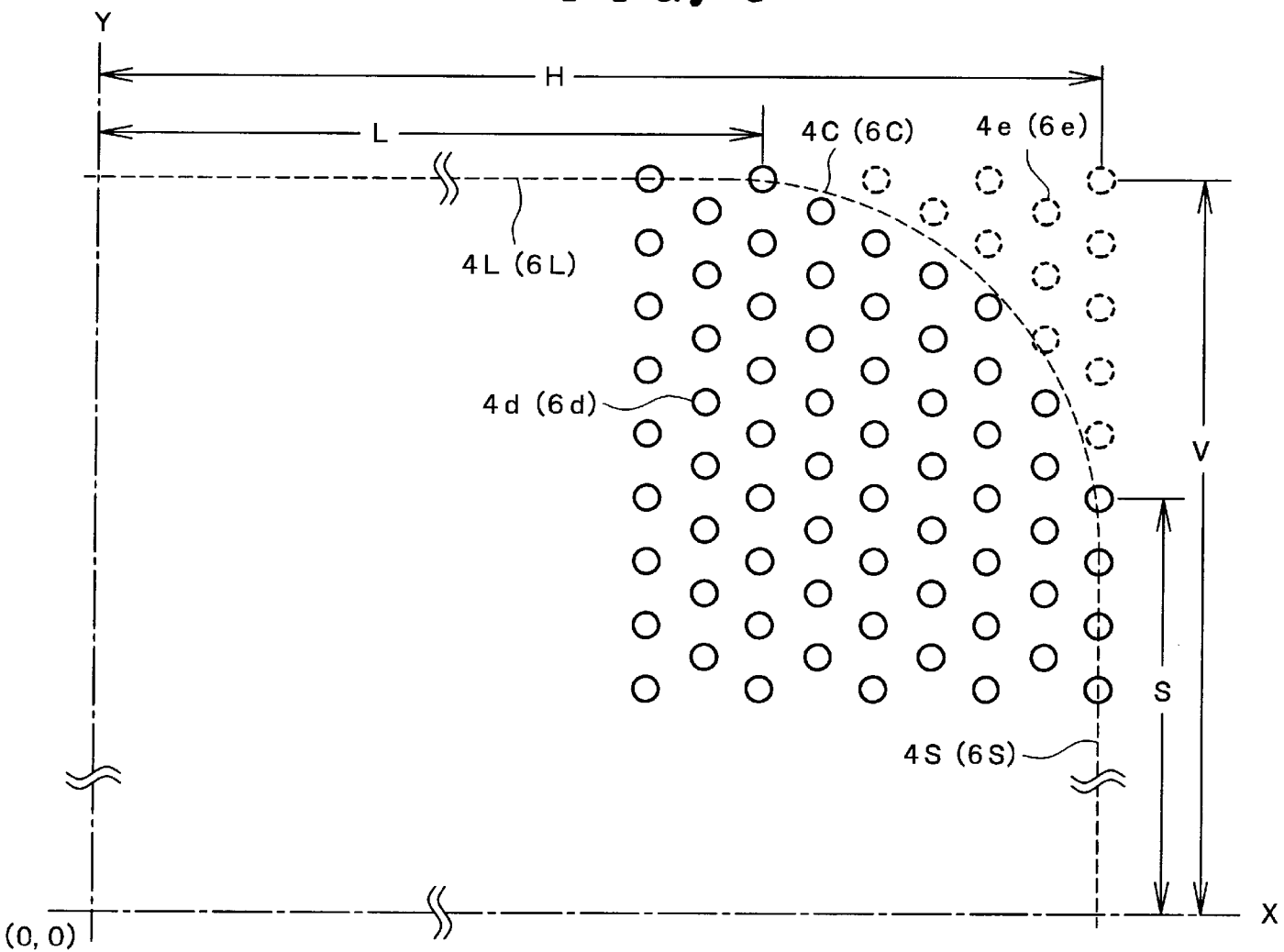
FIG. 5 is an essential-part explanatory view showing an arrangement state of phosphor pixels (or electron beam passing apertures) in the vicinity of a corner portion of the phosphor layer effective region (or shadow mask apertures region) of the present invention.
Figure 6:
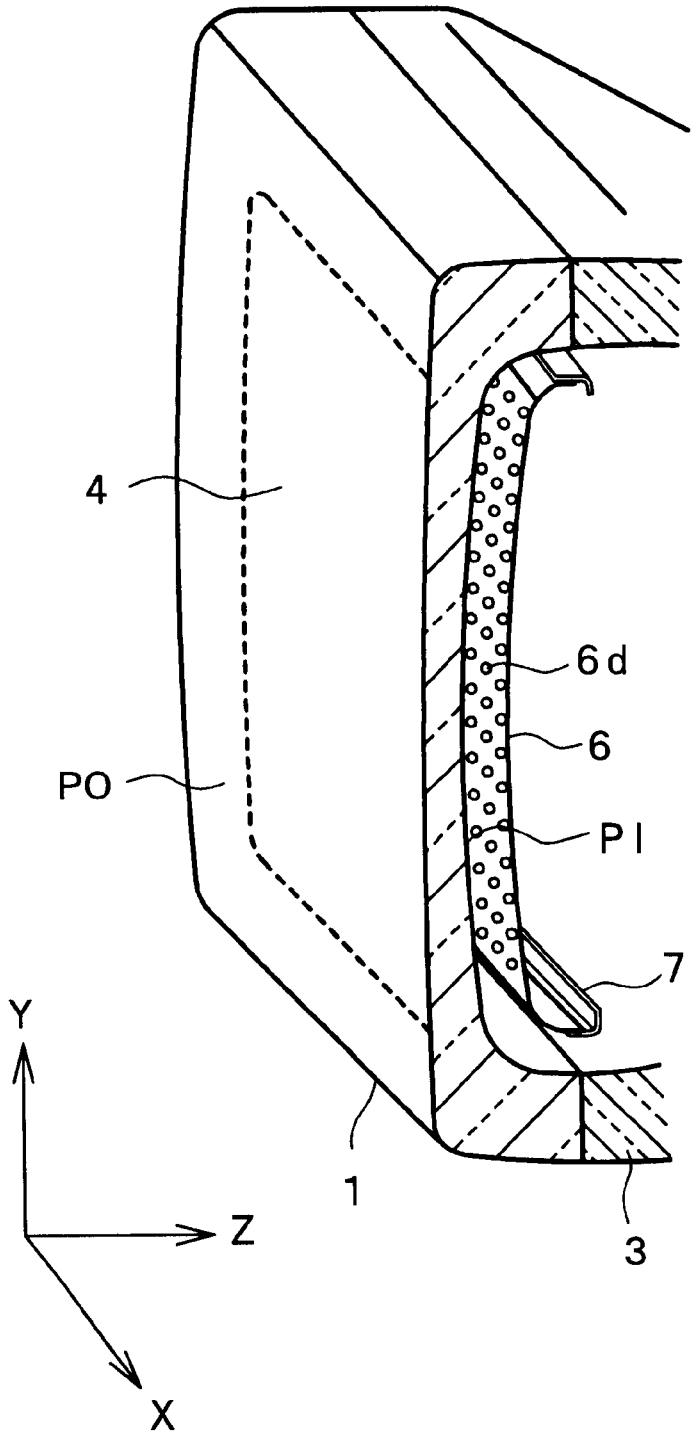
FIG. 6 is a schematic essential-part cross-sectional view for explaining a structural example of a flat panel type color cathode ray tube.

FIG. 5 is an essential-part explanatory view showing the arrangement state of phosphor pixels (or electron beam passing apertures) in the vicinity of a corner portion of the effective region of the phosphor layer (or the apertures region of the shadow mask) of the present invention.

In case FIG. 5 shows the effective region of the phosphor layer, numeral 4*d* indicates pixels which are disposed at the center of tri-color phosphor pixels arranged in an in-line array in the X direction. Although the fact is that pixels of other colors are disposed at both sides of the pixels 4*d* arranged at the center, they are omitted from the drawing. Each phosphor pixel 4*d* has a dot shape surrounded by a black matrix.

On the other hand, in case FIG. 5 shows the apertures region of the shadow mask, numeral 6*d* indicates electron beam passing apertures. Each electron beam passing aperture 6*d* has a dot shape.

In FIG. 5, the phosphor pixels 4*e* (or electron beam passing apertures 6*e*) indicated by dashed lines are formed when the long-side periphery 4L (or 6L) and the short-side periphery 4S (or 6S) of the phosphor layer effective region (or the shadow mask apertures region) are extended to a corner and are directly intersected with each other.

To the contrary, in the present invention, since the effective region (or apertures region) is partitioned by the corner-side periphery 4C (or 6C) which connects the long-side periphery 4L (or 6L) and the short-side periphery 4S (or 6S), the phosphor pixels 4*e* (or electron beam passing apertures 6*e*) indicated by the dashed lines are not formed.

In FIG. 5, although the phosphor pixels 4*d* (or electron beam passing apertures 6*d*) which are formed according to the present invention are completely disposed inside the corner-side periphery 4C (or 6C) at the corner region, there may be a case that the phosphor pixels 4*d* (or electron beam passing apertures 6*d*) are disposed on the corner-side periphery 4C (or 6C).

That is, according to the present invention, assuming the ½ (half) of the maximum effective diameter in the horizontal direction (parallel to the X axis) as H, the ½ (half) of the length in the horizontal direction along the long-side periphery 4L as L, the ½ (half) of the maximum effective diameter in the vertical direction (parallel to the Y axis) as V, and the ½ (half) of the length in the vertical direction along the short-side periphery 4S as S, to make the visual characteristics of the screen and the coating performance of the phosphor compatible, H-L and V-S are set to not less than 1.5 mm.

Further, by restricting the recessed quantities Px, Py of the long-side periphery 4L and the short-side periphery 4S in the direction toward the center of the effective region to values close to the lower limits so as to set the above-mentioned H-L and V-S to not less than 3 mm, an advantageous effect that the effective region of the phosphor layer can be enlarged is obtained.

Further, to ensure the square (rectangular) feeling of the screen, the above-mentioned H-L and V-S are set to not more than 10 mm.

In the present invention, since the effective region has the pincushion shape which has the short-side periphery 4S or the long-side periphery 4L recessed toward the center of the effective region on the X axis or on the Y axis, H becomes the distance in the horizontal direction from the Y axis to the short-side periphery 4S in the vicinity of the corner portion and V becomes the distance in the vertical direction from the X axis to the long-side periphery 4L in the vicinity of the corner portion. Further, L becomes the distance in the horizontal direction from the Y axis to an end portion of the outermost lateral row of the phosphor pixels 4*d* and S becomes the distance in the vertical direction from the X axis to an end portion of the outermost longitudinal row of the phosphor pixels 4*d*.

Further, in the present invention, the shadow mask has the same relationship as the phosphor layer by respectively replacing the above-mentioned 4L, 4S and 4*d* with 6L, 6S and 6*d*. However, the values of H-L and V-S in the shadow mask are set smaller than the values of H-L and V-S in the phosphor layer by 2–3% in view of the relationship of the magnification.

Due to the provision of this embodiment, the feeling of flatness as seen from the outer surface of the panel can be enhanced and the enlargement of the effective region and coating performance of the phosphor can be enhanced.

As has been explained heretofore, according to one embodiment of the present invention, it becomes possible to provide the color cathode ray tube which can enlarge the effective region of the phosphor layer within a range that the feeling of the flatness of the displayed image is not damaged. Further, it also becomes possible to provide the color cathode ray tube which has the favorable feeling of flatness of the displayed image and can enhance the coating performance (easiness of coating operation) of the phosphor layer.

What is claimed is:

1. A color cathode ray tube including a phosphor layer which forms tri-color phosphor pixels arranged in an in-line array in columns on an inner surface of a panel and has an approximately rectangular contour as seen from a tube axis direction and an electron gun which emits three electron beams arranged in an in-line array, wherein assuming an axis which passes the tube axis in the in-line direction of the phosphor layer as a long axis, an axis which passes the tube axis in the direction perpendicular to the in-line direction as a short axis, and an axis which passes the tube axis in the diagonal direction as a diagonal axis, the panel has the relationship of $Rd \geqq 10\ (42.5\ V+45.0)$ where Rd (mm) is an equivalent radius of curvature of an outer surface thereof along a diagonal axis in the phosphor layer and V (inch) is an effective diameter along the diagonal axis of the phosphor layer, the thickness of the panel in the tube axis direction at end portions along the diagonal axis of the phosphor layer is set not less than 200% greater than the thickness of the panel in the tube axis direction at the center, the phosphor layer has the approximately rectangular contour thereof constituted of a pair of long-side peripheries which face each other in an opposed manner while sandwiching the long axis therebetween and cross the short axis, a pair of short-side peripheries which face each other in an opposed manner while sandwiching the short axis therebetween and cross the long axis, and corner-side peripheries which connect the long-side peripheries and the short-side peripheries at corner regions of the phosphor layer, the phosphor layer has at least one of the long-side peripheries and the short-side peripheries recessed toward the center side of the phosphor layer on either the short axis or the long axis compared with portions thereof in the vicinity of the corner regions, and with respect to a contour as defined by center-color phosphor pixels disposed at the center among the tri-color arranged in the in-line array in the phosphor layer, assuming the distance in the long-axis direction from the short axis to the short-side periphery in the vicinity of the corner-side periphery as H, the distance in the long-axis direction from the short axis to an end portion of the outermost lateral column as L, the distance in the short-axis direction from the long axis to the long-side periphery in the vicinity of the corner-side periphery as V, and the distance in the short-axis direction from the long axis to an end portion of the outermost longitudinal column as S, H-L and V-S are set to not less than 1.5 mm.

2. A color cathode ray tube according to claim 1, wherein a recessed quantity of at least one of the long-side peripheries and the short-side peripheries is set to not less than 0.2 mm on the short axis or on the long axis.

3. A color cathode ray tube according to claim 1, wherein H-L and V-S are set to not less than 3 mm.

4. A color cathode ray tube according to claim 1, wherein a recessed quantity of at least one of the long-side peripheries and the short-side peripheries is set to not more than 3 mm on the short axis or on the long axis.

5. A color cathode ray tube according to claim 4, wherein H-L and V-S are set to not more than 10 mm.

6. A color cathode ray tube according to claim 1, wherein the long-side peripheries are formed in a shape which is recessed toward the center side of the phosphor layer on the short axis compared with portions thereof in the vicinity of the corner regions.

7. A color cathode ray tube according to claim 1, wherein the short-side peripheries are formed in a shape which is recessed toward the center side of the phosphor layer on the long axis compared with portions thereof in the vicinity of the corner regions.

8. A color cathode ray tube according to claim 1, wherein the long-side peripheries are formed in a shape which is recessed toward the center side of the phosphor layer on the short axis compared with portions thereof in the vicinity of the corner regions and the short-side peripheries are formed in a shape which is recessed toward the center side of the phosphor layer on the long axis compared with portions thereof in the vicinity of the corner regions.

9. A color cathode ray tube according to claim 8, wherein a recessed quantity of the long-side peripheries is larger than a recessed quantity of the short-side peripheries.

10. A color cathode ray tube according to claim 1, wherein the corner-side peripheries are formed in a linear shape.

11. A color cathode ray tube including a phosphor layer which is formed on an inner surface of a panel and having an approximately rectangular contour as seen from a tube axis direction, a shadow mask being disposed in the vicinity of the phosphor layer and forming an apertures region which has a large number of electron beam passing apertures arranged in columns and has an approximately rectangular contour as seen from a tube axis direction, and an electron gun which emits three electron beams arranged in an in-line array, wherein assuming an axis which passes the tube axis in the in-line direction of the phosphor layer or the apertures region of the shadow mask as a long axis, an axis which passes the tube axis in the direction perpendicular to the in-line direction as a short axis, and an axis which passes the tube axis in the diagonal direction as a diagonal axis, the panel has the relationship of $Rd \geqq 10\ (42.5\ V+45.0)$ where Rd (mm) is an equivalent radius of curvature at an outer surface along a diagonal axis in the phosphor layer and V (inch) is an effective diameter along the diagonal axis of the phosphor layer, the shadow mask has the apertures region formed in a curved shape which is curved in the long-axis direction and in the short-axis direction, the shadow mask has the apertures region of an approximately rectangular contour which is constituted of a pair of long-side peripheries which face each other in an opposed manner while sandwiching the long axis therebetween and cross the short axis, a pair of short-side peripheries which face each other in an opposed manner while sandwiching the short axis therebetween and cross the long axis, and corner-side peripheries which connect the long-side peripheries and the short-side peripheries at corner regions of the apertures region, the shadow mask has at least one of the long-side peripheries and the short-side peripheries recessed toward the center side of the apertures region on either the short axis or the long axis compared with portions thereof in the vicinity of the corner regions, with respect to a contour of the apertures region in the shadow mask, assuming the distance in the long-axis direction from the short axis to the short-side periphery in the vicinity of the corner-side periphery as H, the distance in the long-axis direction from the short axis to an end portion of the outermost lateral column as L, the distance in the short-axis direction from the long axis to the long-side periphery in the vicinity of the corner-side periphery as V, and the distance in the short-axis direction from the long axis to an end portion of the outermost longitudinal column as S, H-L and V-S are set to not less than 1.5 mm.

12. A color cathode ray tube according to claim 11, wherein a recessed quantity of at least one of the long-side peripheries and the short-side peripheries is set to not less than 0.2 mm on the short axis or on the long axis.

13. A color cathode ray tube according to claim 11, wherein H-L and V-S are set to not less than 3 mm.

14. A color cathode ray tube according to claim 11, wherein a recessed quantity of at least one of the long-side peripheries and the short-side peripheries is set to not more than 3 mm on the short axis or on the long axis.

15. A color cathode ray tube according to claim 14, wherein H-L and V-S are set to not more than 10 mm.

16. A color cathode ray tube according to claim 11, wherein the long-side peripheries are formed in a shape which is recessed toward the center side of the apertures region on the short axis compared with portions thereof in the vicinity of the corner regions.

17. A color cathode ray tube according to claim 11, wherein the short-side peripheries are formed in a shape which is recessed toward the center side of the apertures region on the long axis compared with portions thereof in the vicinity of the corner regions.

18. A color cathode ray tube according to claim 11, wherein the long-side peripheries are formed in a shape which is recessed toward the center side of the apertures region on the short axis compared with portions thereof in the vicinity of the corner regions and the short-side peripheries are formed in a shape which is recessed toward the center side of the apertures region on the long axis compared with portions thereof in the vicinity of the corner regions.

19. A color cathode ray tube according to claim 18, wherein a recessed quantity of the long-side peripheries is larger than a recessed quantity of the short-side peripheries.

20. A color cathode ray tube according to claim 11, wherein the corner-side peripheries are formed in a linear shape.

* * * * *